US011300005B2

(12) United States Patent
Vindler et al.

(10) Patent No.: US 11,300,005 B2
(45) Date of Patent: Apr. 12, 2022

(54) MASKING SYSTEMS FOR A TURBINE

(71) Applicant: Siemens Energy, Inc., Orlando, FL (US)

(72) Inventors: Michael R. Vindler, Pittsburgh, PA (US); Michael A. Hall, Greensburg, PA (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 17/429,362

(22) PCT Filed: Feb. 15, 2019

(86) PCT No.: PCT/US2019/018187
§ 371 (c)(1),
(2) Date: Aug. 9, 2021

(87) PCT Pub. No.: WO2020/167315
PCT Pub. Date: Aug. 20, 2020

(65) Prior Publication Data

US 2022/0042421 A1 Feb. 10, 2022

(51) Int. Cl.
*F01D 25/00* (2006.01)
*B24C 1/04* (2006.01)
*B24C 3/32* (2006.01)

(52) U.S. Cl.
CPC ..... *F01D 25/002* (2013.01); *B24C 1/04* (2013.01); *B24C 3/32* (2013.01); *F05D 2230/72* (2013.01)

(58) Field of Classification Search
None
See application file for complete search history.

(56) References Cited

U.S. PATENT DOCUMENTS 5,486,281 A * 1/1996 Gruver ..... C25D 5/022 205/110
5,998,755 A 12/1999 Zajchowski et al.
(Continued)

FOREIGN PATENT DOCUMENTS

EP 0927773 A2 7/1999
WO 2010048931 A1 5/2010

OTHER PUBLICATIONS

PCT International Search Report and Written Opinion of International Searching Authority dated Nov. 20, 2019 corresponding to PCT International Application No. PCT/US2019/018187 filed Feb. 15, 2019.

*Primary Examiner* — Ninh H. Nguyen
*Assistant Examiner* — Jason G Davis

(57) ABSTRACT

A masking system for a turbine including a first quantity of blades attached to a rotor and arranged adjacent one another to define a blade row with each blade including a blade root, includes a second quantity of center plates. Each center plate is disposed between two adjacent blades and includes a resilient member in contact with each of the two adjacent blades, and a first attachment member operable to attach the center plate to the rotor. The system includes a third quantity of side covers, each side cover positioned adjacent the blade root of one of the blades and connected to one of the center plates, each side cover including a resilient member positioned to surround a portion of the adjacent blade root, and a second attachment member operable to attach the side cover to the rotor.

24 Claims, 8 Drawing Sheets

(56) References Cited

U.S. PATENT DOCUMENTS

| | | | | |
|---|---|---|---|---|
| 6,037,004 | A * | 3/2000 | Zajchowski | B05B 12/20 427/282 |
| 9,657,405 | B2 * | 5/2017 | Etuve | F01D 5/288 |
| 2013/0045096 | A1 | 2/2013 | Etuve et al. | |
| 2016/0258046 | A1 | 9/2016 | Uihlein et al. | |

* cited by examiner

MASKING SYSTEMS FOR A TURBINE

TECHNICAL FIELD

The present disclosure is directed, in general, to a turbine blade masking system, and more specifically to a turbine blade masking system that is easily added to and removed from the turbine without causing damage.

BACKGROUND

During routine maintenance on steam and gas turbines, the rotating components are often removed, cleaned and inspected for wear and damage. Part of the cleaning process often includes a grit blasting process such as sand blasting. During a grit blasting process, grit can impact or become lodged in the interface between the turbine blades and the rotor. This grit could cause damage during future operation.

SUMMARY

A masking system for a turbine including a first quantity of blades attached to a rotor and arranged adjacent one another to define a blade row with each blade including a blade root, includes a second quantity of center plates. Each center plate is disposed between two adjacent blades and includes a resilient member in contact with each of the two adjacent blades, and a first attachment member operable to attach the center plate to the rotor. The system includes a third quantity of side covers, each side cover positioned adjacent the blade root of one of the blades and connected to one of the center plates, each side cover including a resilient member positioned to surround a portion of the adjacent blade root, and a second attachment member operable to attach the side cover to the rotor.

In another construction, a masking system for a turbine including a first quantity of blades attached to a rotor and arranged adjacent one another to define a blade row with each blade including a blade root includes a second quantity of center plates, each center plate disposed between two adjacent blades. Each center plate includes a base member sized to fit between the blades and contact the rotor, a first attachment member supported by the base member and positioned to selectively connect the base member to the rotor, a resilient member coupled to the base member to retain the first attachment member within the base member, the resilient member sized to contact both of the adjacent blades, and a support member sized to fit between the blades and fixedly connected to the base member.

In another construction, a masking system for a turbine including a first quantity of blades attached to a rotor and arranged adjacent one another to define a blade row with each blade including a blade root includes a second quantity of center plates, each disposed between two adjacent blades and a third quantity of side covers, each side cover positioned adjacent the blade root of one of the blades. Each side cover includes a plate member sized to cover the blade root and a portion of the rotor such that the plate members cooperate to completely cover an annular area that includes each blade root and a rotor surface between the blade roots, a resilient member positioned between the rotor and the plate member and sized to surround a perimeter of the blade root, and a first attachment member coupled to the plate member and operable to attach the plate member to the rotor and to compress the resilient member between the plate member and the rotor.

The foregoing has outlined rather broadly the technical features of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiments disclosed as a basis for modifying or designing other structures for carrying out the same purposes of the present disclosure. Those skilled in the art will also realize that such equivalent constructions do not depart from the spirit and scope of the disclosure in its broadest form.

Also, before undertaking the Detailed Description below, it should be understood that various definitions for certain words and phrases are provided throughout this specification and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

Figure 1:
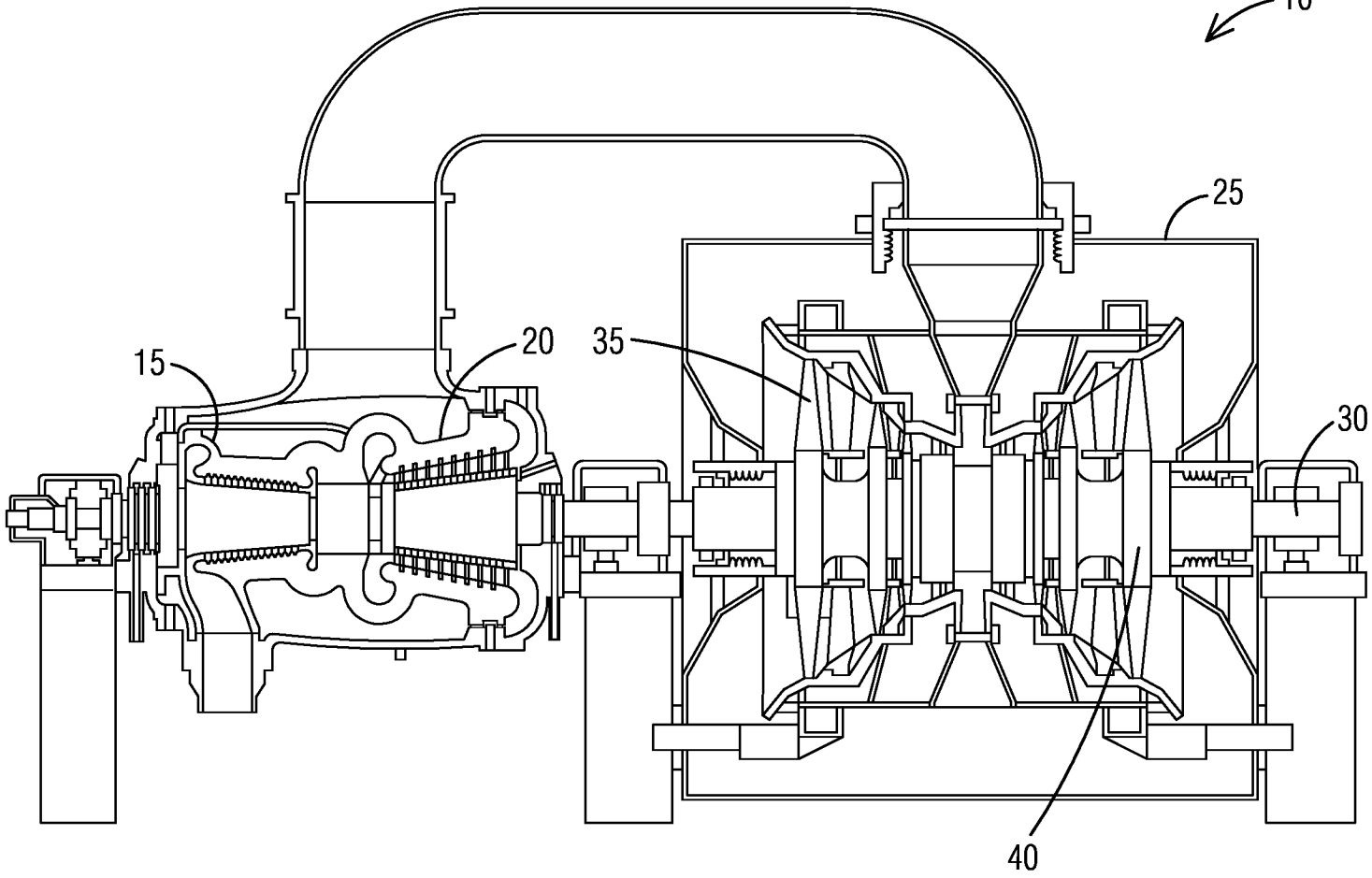
FIG. 1 is a longitudinal cross section of a low-pressure steam turbine.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements.

Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean: that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard as available a variation of 20 percent would fall within the meaning of these terms unless otherwise stated.

FIG. 1 is a longitudinal cross-sectional view of a steam turbine 10. Typical steam turbines 10 include a high-pressure (HP) section 15, an intermediate pressure (IP) section 20, and one or more low pressure (LP) sections 25. High-pressure, high-temperature steam expands in the high-pressure section 15 to produce rotational torque. The steam is then reheated and redirected to the intermediate-pressure section 20 for further expansion. Finally, the steam is directed to the low-pressure section 25 or sections to complete the expansion process. One or more rotors 30 extend along the length of the HP, IP, and LP sections 15, 20, 25 and support rotating blades 35 which act to convert the energy of the steam to rotational energy or torque.

Figure 2:
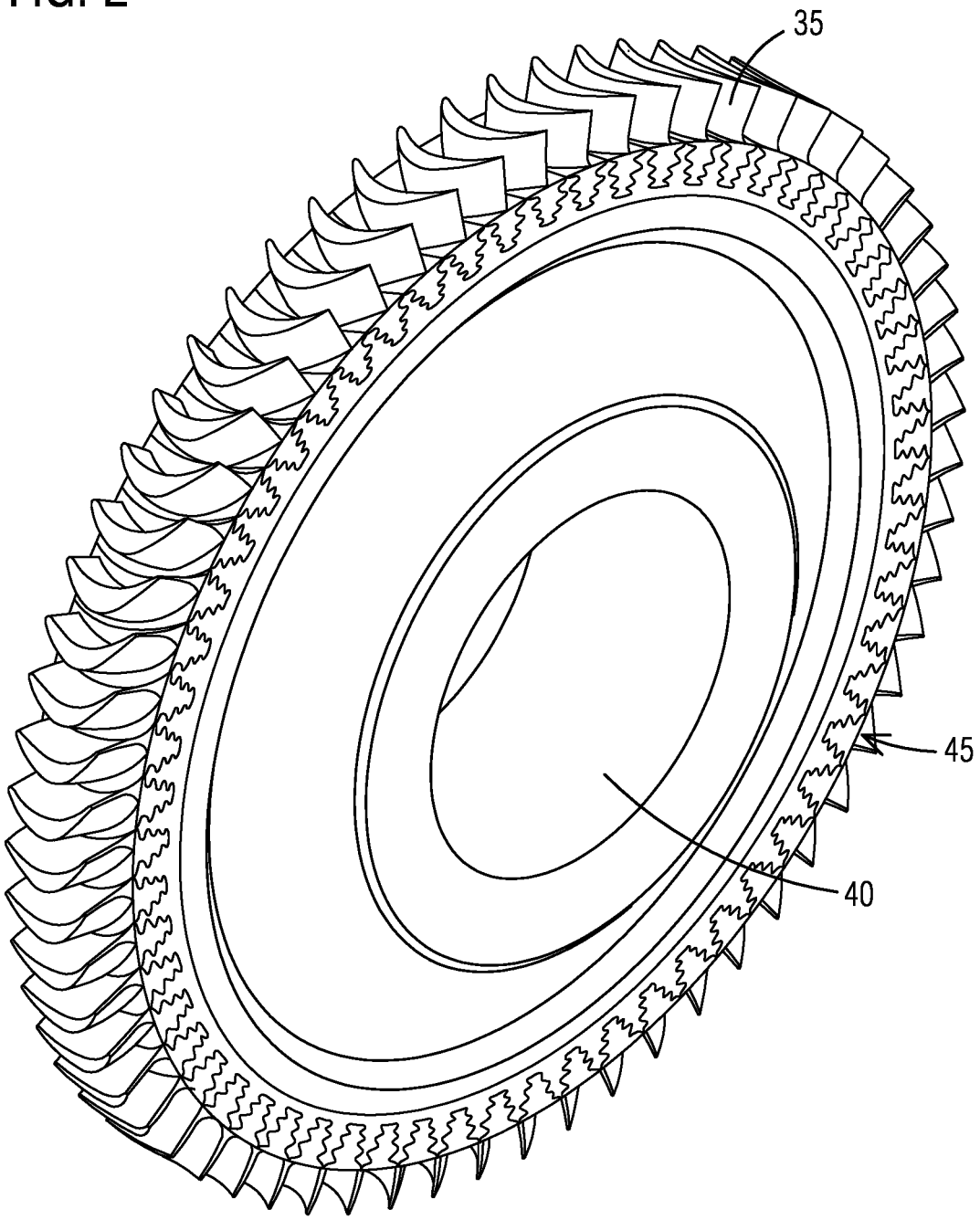
FIG. 2 is a perspective view of a portion of a rotor of the low-pressure steam turbine of FIG. 1.

As illustrated in FIG. 2, the rotor 30 includes several rows or stages of blades 35 positioned in the HP, IP, and LP sections 15, 20, 25 and arranged to cooperate with corresponding rows of stationary blades to extract and convert energy from the steam. The rotating blades 35 generate the torque in response to the expansion of the flow of steam which is used to drive a generator or other device attached to the rotor 30 or rotors.

It should be noted that while a steam turbine 10 is described herein, the device described herein could be applied to gas turbine engines as well.

The illustrated rotor 30 includes several disk portions 40 that are either formed as part of the rotor 30 or attached to the rotor 30 and that each define an attachment area 45 for one of the turbine stages. While blades 35 and rotors 30 can be designed with multiple different entry arrangements (e.g., radial entry, axial entry, tangential entry) the illustrated rotor 30 includes grooves 50 arranged in a curved fir tree arrangement that receives blades 35 in a generally axial direction 55. In this arrangement, each blade 35 is received in its own individual groove 50. The blades 35 each include a vane portion 60 (cut off in the figures for clarity), a platform 65, and a corresponding blade root 70 to provide for the necessary fit with the blade grooves 50. With the illustrated style of blade attachment, the interface between each blade 35 and the rotor disk 40 is visible and exposed on each side of the disk 40. In addition, interface lines 75 between the platforms 65 and the disk 40 are created above the blade root 70. Each blade's vane portion 60 extends radially outward from the platform 65 and interfaces with the flow of steam (or combustion gases in a gas turbine) to produce torque. Each pair of adjacent blades 35 cooperate to define a blade space 80 therebetween. The blade space 80 has an axial length 85 that is about equal to the axial length of the blade platforms 65 or the disk 40 and a width 90 that is defined by the distance between a suction side 95 of one blade 35 and the pressure side 100 of the adjacent blade 35. The width 90 varies depending upon where it is measured as the distance between the suction side 95 of one blade 35 and the pressure side 100 of the adjacent blade 35 varies.

Figure 3:
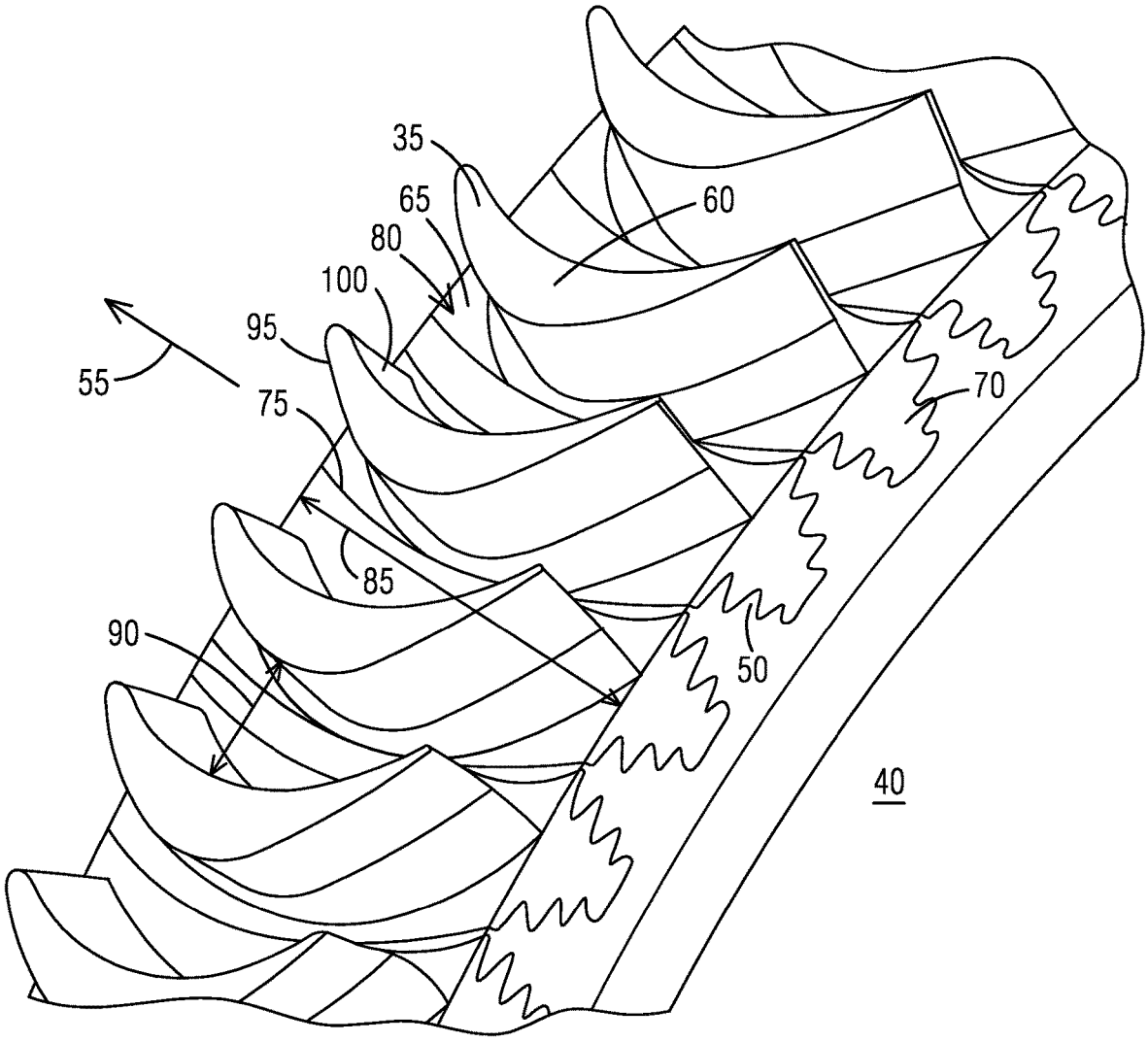
FIG. 3 is an enlarged perspective view of a stage of the rotor of FIG. 2 without masking.

The fit between the blade root 70 and the groove 50 is extremely precise and is best illustrated in FIG. 3. Variations in the fit can create high stress location that might lead to cracking due to high cycle fatigue or other mechanisms. During maintenance cycles, the rotor 30, including the disks 40 and the blades 35 is cleaned and inspected to assure that the desired fit has been maintained and that there is no unexpected damage. One cleaning process that is often employed is grit blasting. During this process, a grit such as sand or other abrasive particles is mixed with high pressure air and directed at the rotor 30. The grit removes scale, combustion gas remnants (in gas turbines), and other substances that might collect on the rotor 30 without damaging the rotor 30, the disks 40, or the blades 35. During this process, it is possible for the grit to become lodged in the interfaces 75 between the blades 35 and the disk 40. To reduce the likelihood of this occurring, these areas are masked or covered as illustrated in FIG. 4 using the components illustrated in FIGS. 5- and 9.

Figure 4:
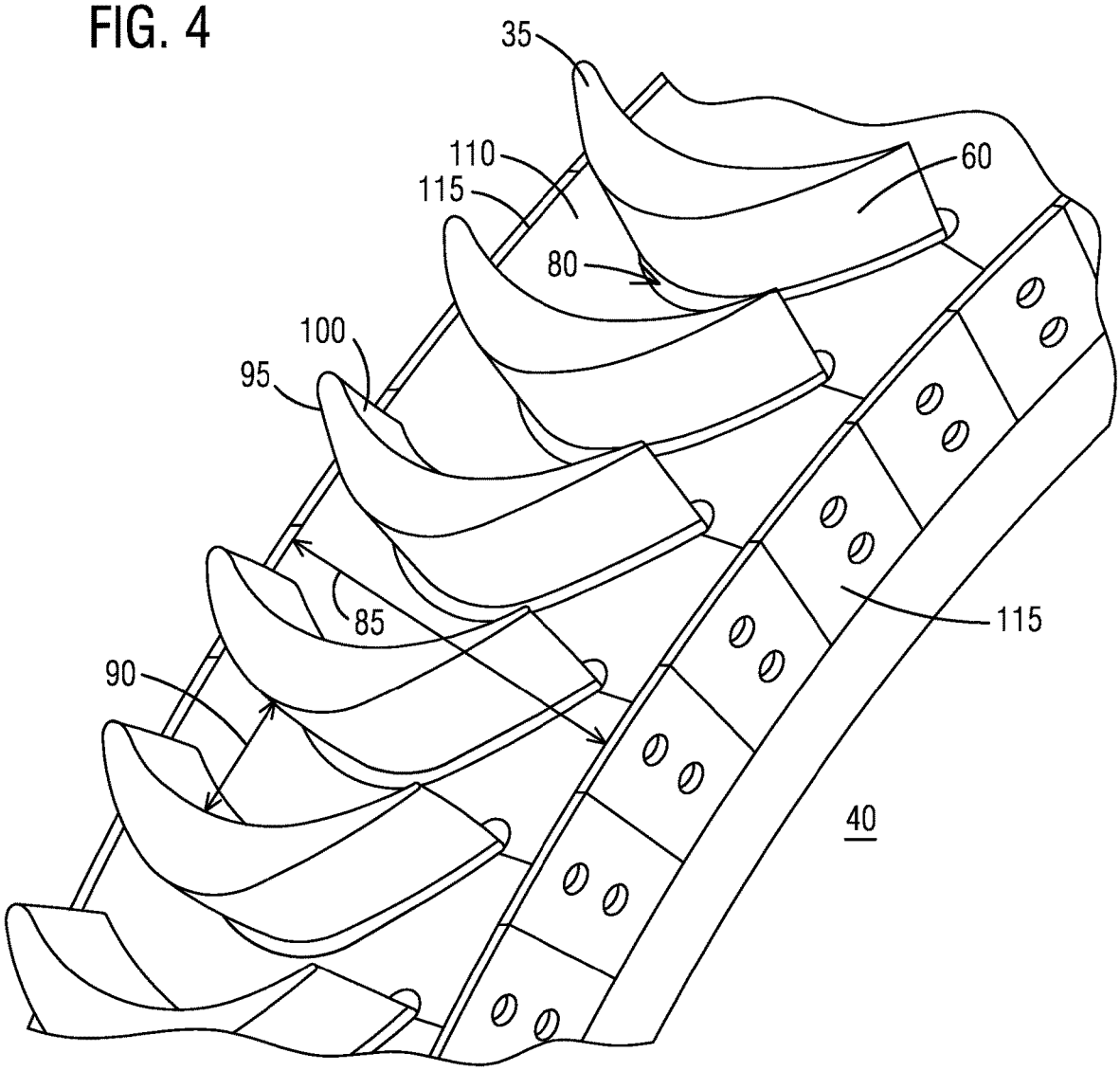
FIG. 4 is an enlarged perspective view of a stage of the rotor of FIG. 2 with masking.

With reference to FIG. 4, the portion of the rotor 30 of FIG. 3 is illustrated with a masking system 105 in place. The masking system 105 includes a number of center plates 110 and a number of side covers 115. The center plates 110 are positioned between adjacent blades 35 to cover the interface lines 75 between the blade platforms 65 and the disk 40. Typically, the number of center plates 110 required is equal to the number of blades 35 in the row being masked. The side covers 115 engage the center plates 110 and cooperate to cover the interface lines 75 and the interface formed between the blade roots 70 and the disk grooves 50 on either side of the disk 40. In most constructions, twice as many side covers 115 than center plates 110 are required. However, the side covers 115 could be arranged to cover two or more root areas if desired, thereby reducing the number of side covers 115 required.

Figure 5:
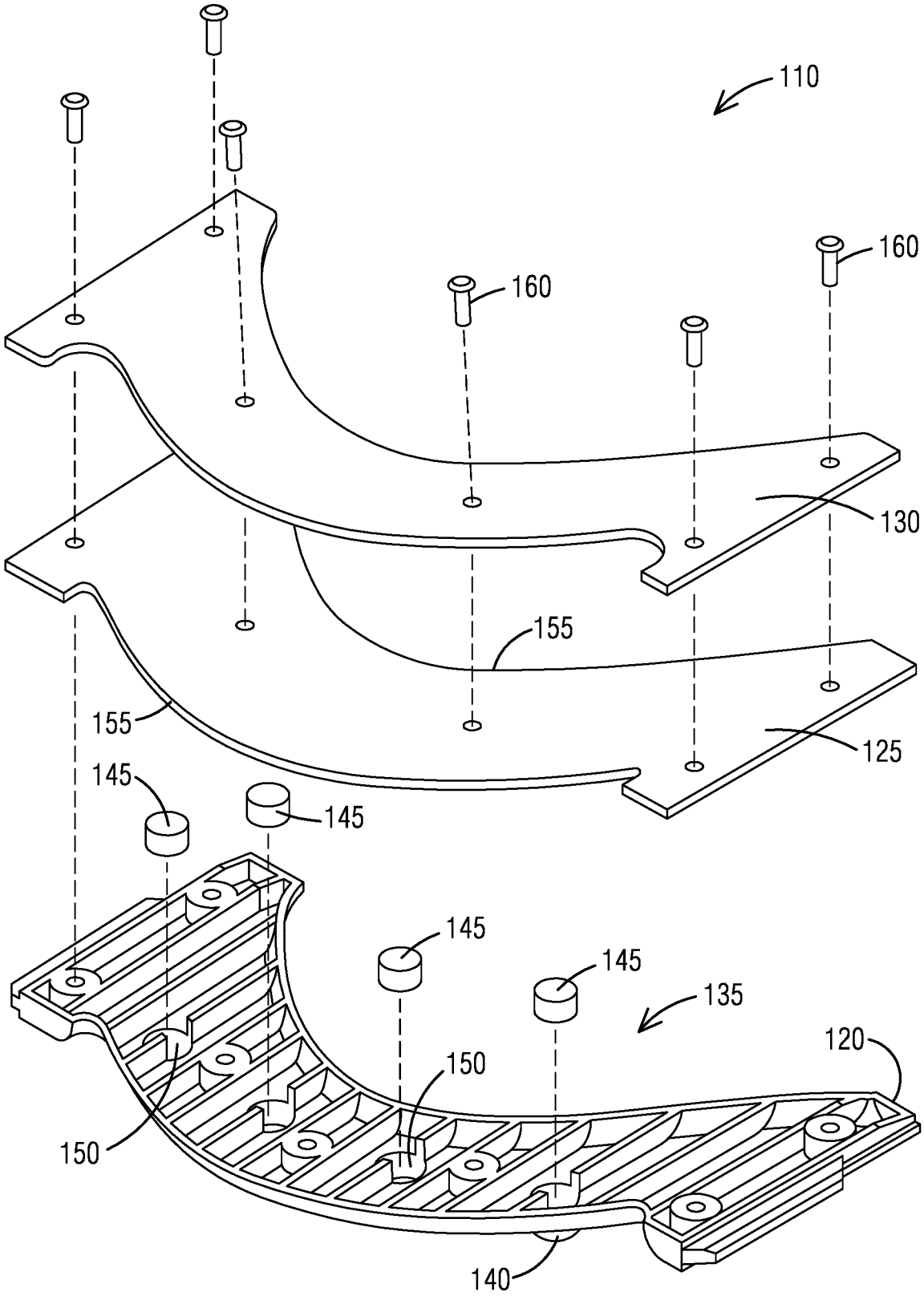
FIG. 5 is an exploded perspective view of a center plate for covering a portion of the stage of FIG. 3.

FIG. 5 illustrates one arrangement of a center plate 110. Before proceeding, it should be understood that the size and shape of the center plates varies 110 to accommodate the size and shape of the particular stage in which it fits. For example, larger or wider blades 35 (axial width) may require a longer center plate 110. In addition, the width of the center plates 110 (distance between adjacent blades 35) may vary depending upon the spacing between adjacent blades 35.

Each center plate 110 includes a base member 120, a resilient member 125, a support member 130, and an attachment member 135. The base member 120 is preferably a plastic component that is smaller than the space 80 between adjacent blades 35. The base member 120 is arranged to sit on the disk 40 and/or blade platforms 65 in the space 80 between adjacent blades 35. In some constructions, standoffs 140 are formed on the exterior surface of the base member 120 and are arranged to contact the surface of the platforms 65 or the disk 40. In addition, the base member 120 is formed to receive and hold the attachment member 135 in place. The attachment member 135 operates to selectively attach the base member 120 and in turn the center plate 110 to the disk 40 and/or blade platforms 65. In the illustrated construction, the attachment member 135 includes four separate disk-shaped magnets 145 that are held in corresponding apertures 150 formed as part of the base member 120. Of course, different numbers, sizes, or shaped magnets 145 could be employed as part of the attachment member 135. In addition, other attachment members 135 (e.g., adhesives, vacuum, hook-and-loop fasteners, etc.) could be employed in place of or in conjunction with the magnets 145. Any attachment member 135 should allow for the easy installation and removal of the center plates 110 without causing any harm or damage to the components to which it attaches, and preferably without the need for any tools. While any magnet 145 can be employed, neodymium iron boron magnets 145 are preferred. Rare-earth magnets could be employed but the additional magnetic force and cost are not necessary.

The resilient member 125 includes a sheet of resilient material such as silicon foam, rubber, and the like. The resilient member 125 is sized to have a length (measured axially with respect to the turbine) that is about equal to the length of the blade space 80. Two curved edges 155 of the resilient member 125 define a width that is slightly larger than the width of the blade space 80 at any given point. The slightly larger size assures that when the resilient member 125 is positioned between the blades 35 adjacent the blade platforms 65, the edges 155 remain in contact with the blades 35 at all points to form a seal. The resilient member 125 is positioned on top of the base member 120 and can be unattached or attached using any attachment mechanism including fasteners such as screws or rivets.

The support member 130 is formed from a sheet of plastic material and is sized to fit easily within the blade space 80. The support member 130 is positioned on top of the resilient member 125 and provides structural support for the resilient member 125. In preferred constructions, fasteners 160 such as rivets or screws attach the support member 130 directly to the base member 120 while sandwiching the resilient member 125 therebetween.

Figure 8:
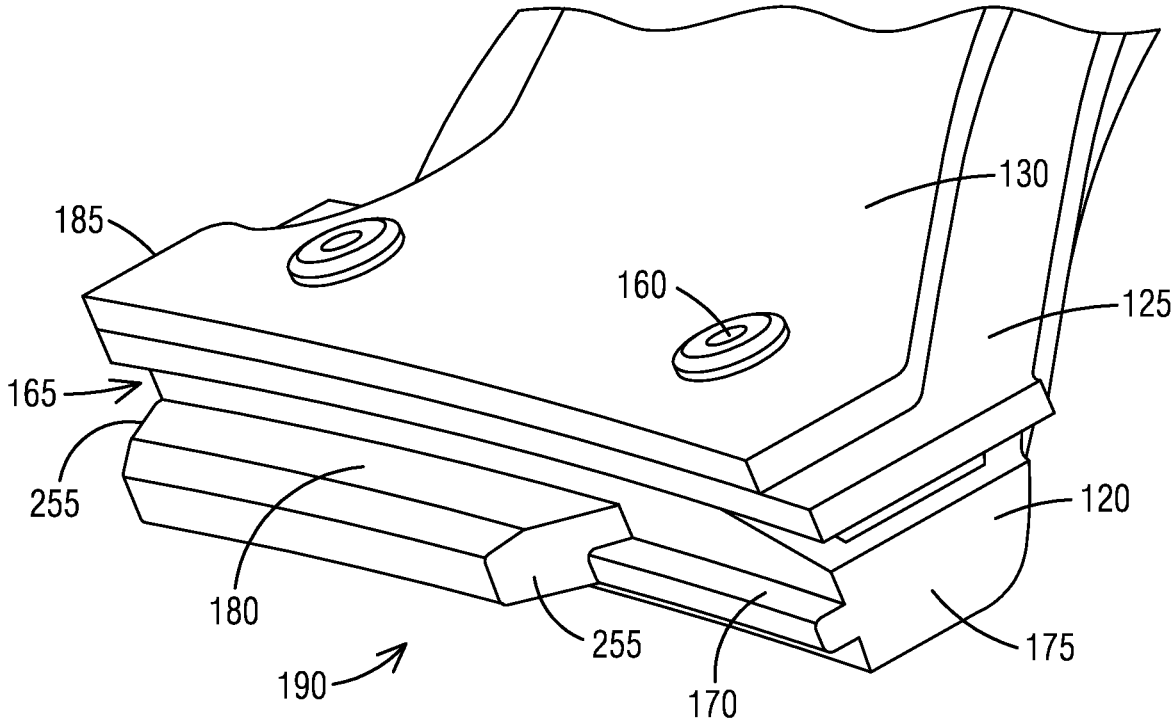
FIG. 8 is an enlarged perspective view of an end of the center plate of FIG. 5.

As illustrated in FIGS. 5 and 8, the base member 120, the resilient member 125, and the support member 130 terminate at two end walls 165 best illustrated in FIG. 8. The base member 120 includes a small tab portion 170 that extends from a first end 175 of the end wall 165 along a portion of the length of the end wall 165. A large tab portion 180 extends from the end of the small tab portion 170 to an opposite second end 185 of the end wall 165. The large tab portion 180 and the small tab portion 170 cooperate to define a tongue or first interlocking portion 190.

Figure 6:
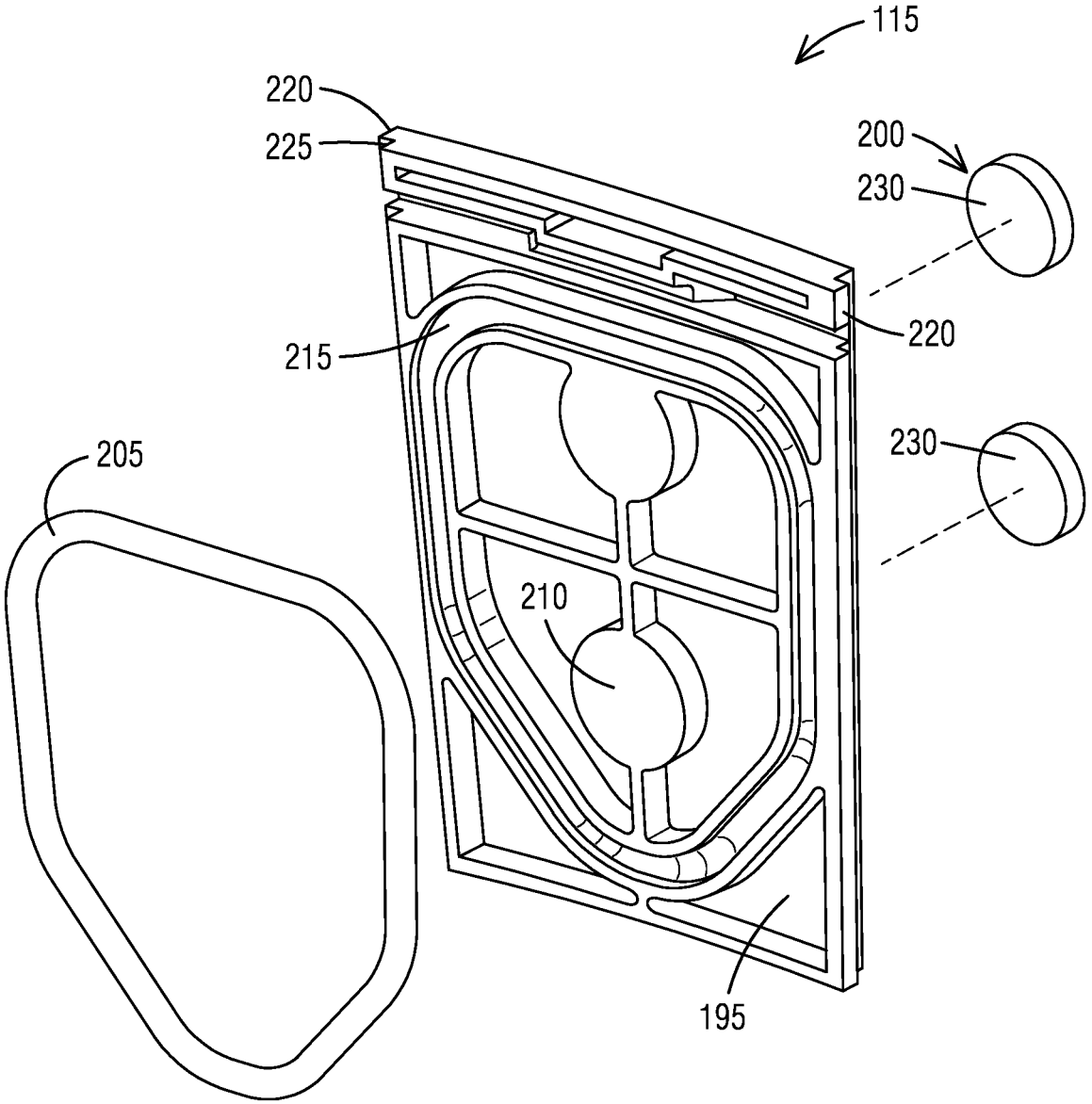
FIG. 6 is an exploded perspective view of a side cover for covering a portion of the stage of FIG. 3.

Turning to FIG. 6, each side cover 115 includes a plate member 195, an attachment member 200, and a resilient member 205. The resilient member 205 is preferably an O-ring made from a rubber or silicon material with other materials also being suitable. A standard circular cross-section O-ring is generally sufficient for the purpose of sealing the blade root 70 with other shapes or arrangements being possible.

Figure 9:
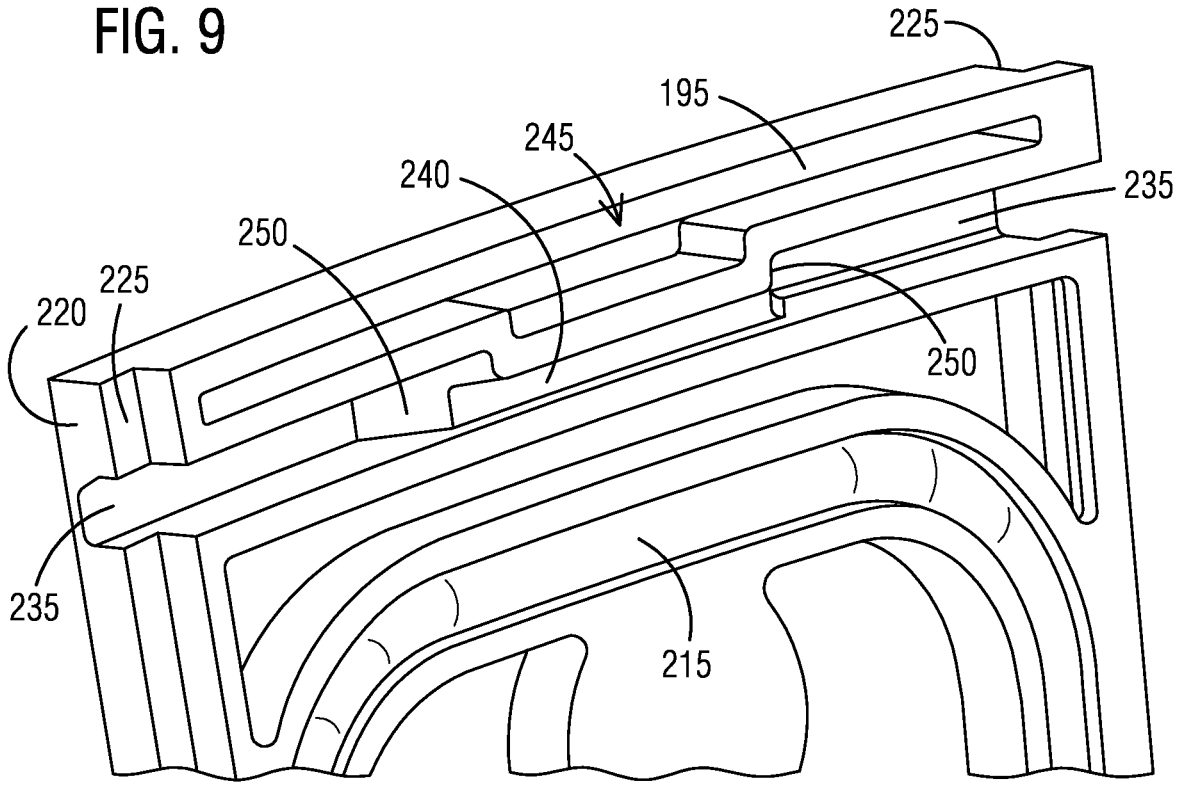
FIG. 9 is an enlarged perspective view of a portion of the end plate of FIG. 6.

The plate member 195 is preferably a plastic component that includes a pocket 210 or space sized to receive the attachment member 200. Each plate member 195 also includes a groove 215 that is sized to receive and hold the resilient member 205 in a position that surrounds the blade root 70 when the side cover 115 is properly positioned. Each plate member 195 defines two side portions 220 that are stepped to allow for the interlocking of adjacent side covers 115. As is best illustrated in FIG. 9, the side portions 220 each define a step 225 with the steps 225 being mirror images of one another. Thus, the step 225 of a left side 220 of a first side cover 115 interlocks with the step 225 of a right side 220 of a second adjacent side cover 115.

In the illustrated construction, the attachment member 200 of each side cover 115 includes two magnets 230 similar to those used in the center plate 110, with more or fewer magnets 230, or differently shaped magnets 230 being possible. Of course, like the center plate 110, other attachment members 200 could be employed if desired. As with the center plate 110, other attachment members 200 should allow for easy application and removal of the side covers 115 without damage to any components and without the need for tools.

As illustrated in FIGS. 6 and 9, each plate member 195 includes two large grooves 235 that each extend from one of the side portions 220 toward one another. A small groove 240 is positioned between the two large grooves 235 and connects the two large grooves 235 to define a second interlocking portion 245 arranged to engage the first interlocking portion 190. The small groove 240 is sized and shaped to receive the small tab portion 170 and each of the large grooves 235 is sized and shaped to receive a portion of the large tab portion 180. For example, the large grooves 235 each define an angled end surface 250 that is arranged at an oblique angle with respect to the plane of the plate member 195. The large tab portions 180 include similarly angled ends 255 to assure a close fit therebetween. Of course, other constructions can switch the position of the tabs 170, 180 and grooves 235, 240 such that the tabs 170, 180 are formed on the side cover 115 and the grooves 235, 240 are part of the center plate 110 if desired. In addition, other mechanisms could be used to achieve the desired alignment and interconnection.

Center plates 110 are custom built for each row of blades 35 as the resilient member 125 must fit properly. However, the base member 120 and the support member 130 can be standard parts used on multiple different rows if desired. In preferred constructions, the base member 120 is injection molded and the support member 130 is cut (e.g., laser cut) from a sheet of plastic. Once the base member 120, the resilient member 125, and the support member 130 are attached to one another, they can be used on the desired row of blades 35. In addition, some blade rows may be similar enough that the center plates 110 can be used on different blade rows.

The side covers 115 can be sized to fit on multiple rows of blades 35. However, the width of the side covers 115 is limited by the circumference of the disk 40 such that a shorter disk 40 may require smaller side covers 115 to cover each of the blade roots 70. In preferred constructions, the plate members 195 of the side covers 115 are injection molded plastic with other constructions being possible.

Figure 7:
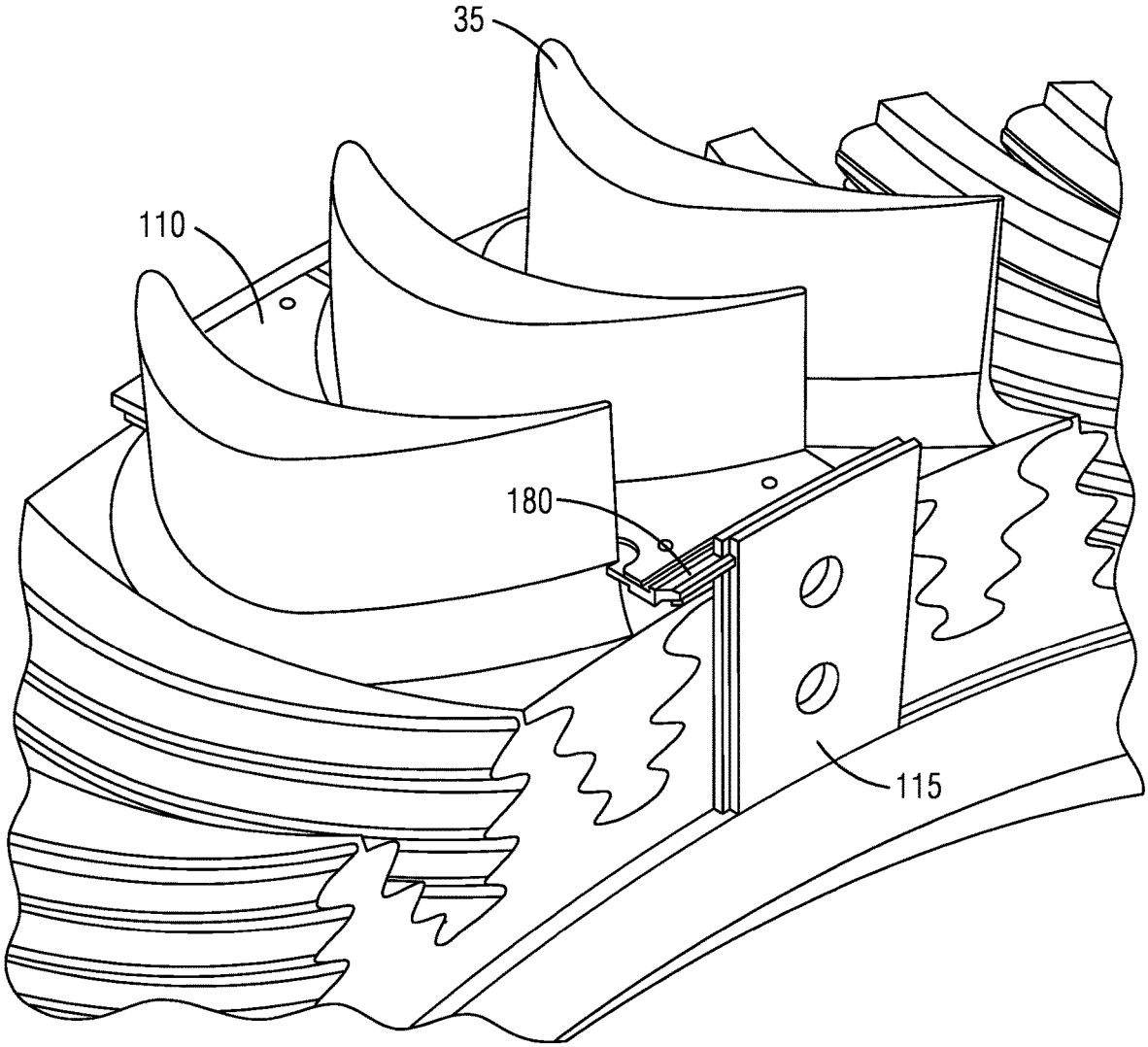
FIG. 7 is a perspective view illustrating the connection between the center plate and one of the side covers.

In use, prior to the blasting operation a user installs the center plates 110 between adjacent blades 35. The center plates 110 may include features that assure proper alignment or may simply be positioned as desired between the blades 35. The attachment member 135, in the form of the four magnets 145, magnetically attaches each center plate 110 in position. The resilient member 125 is sized to fill the space 80 between the blades 35 and form a seal to inhibit the unwanted passage of blasting media or other debris. The side covers 115 are next assembled by positioning the resilient member 205 in the form of O-rings in the grooves 215 of the plate member 195. The side covers 115 are then positioned over the desired blade roots 70. The small groove 240 in the side cover 115 receives the small tab portion 170 of one of the center plates 110 and one of the large grooves 235 receives a portion of the large tab portion 180 of the same center plate 110 as illustrated in FIG. 7. The remainder of the large tab portion 180 is received in one of the large grooves 235 of an adjacent side cover 115. This arrangement assures the proper arrangement and alignment of the side covers 115. The attachment member 200 of the side covers 115, in the form of magnets 230 produce sufficient force to compress the resilient member 205 slightly and hold the side cover 115 in the desired location. Once one side cover 115 is positioned, it presents two stepped side portions 220. One side portion 220 includes a step 225 that receives the step 225 of an adjacent side cover 115 on top of the step 225 of the already positioned side cover 115. Each side cover 115 is sequentially positioned until the last side cover 115. The last side cover 115 must engage two adjacent side covers 115 and once positioned, cooperates with the other side covers 115 to define a complete ring of interlocking side covers 115. Once each side cover 115 is positioned as desired and all the stages are covered, the rotor 30 is ready to be cleaned and blasted.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. A masking system for a turbine including a first quantity of blades attached to a rotor and arranged adjacent one another to define a blade row, each blade including a blade root, the masking system comprising:

a second quantity of center plates, each center plate disposed between two adjacent blades and including a resilient member in contact with each of the two adjacent blades, and a first attachment member operable to attach the center plate to the rotor; and a third quantity of side covers, each side cover positioned adjacent the blade root of one of the blades and connected to one of the center plates, each side cover including a second resilient member positioned to surround a portion of the adjacent blade root, and a second attachment member operable to attach the side cover to the rotor.

2. The masking system of claim 1, wherein the first quantity and the second quantity are equal, and the third quantity is two times the first quantity.

3. The masking system of claim 1, wherein the resilient member includes a silicon foam material.

4. The masking system of claim 1, wherein the resilient member includes a first edge curved to match the shape of a first of the adjacent blades and a second edge curved to match the shape of a second of the adjacent blades, and wherein the resilient member is larger than a space between the first blade and the second blade such that the first edge and the second edge simultaneously contact both of the first blade and the second blade.

5. The masking system of claim 4, wherein the center plate further comprises a base member sized to fit between the blades and contact the rotor.

6. The masking system of claim 5, wherein the center plate further comprises a support member sized to fit between the blades and fixedly connected to the base member.

7. The masking system of claim 6, wherein the resilient member is sandwiched between the base member and the support member.

8. The masking system of claim 5, wherein the first attachment member includes four separate magnets and wherein the base member defines corresponding pockets each sized to receive one of the magnets.

9. The masking system of claim 1, wherein the first attachment member and the second attachment member each include a magnet.

10. The masking system of claim 1, wherein each center plate includes one of a tongue or a groove and each side cover includes the other of the tongue and groove so that each side cover interlocks with one of the center plates.

11. A masking system for a turbine including a first quantity of blades attached to a rotor and arranged adjacent one another to define a blade row, each blade including a blade root, the masking system comprising:

a second quantity of center plates, each center plate disposed between two adjacent blades, each center plate comprising:

a base member sized to fit between the blades and contact the rotor;

a first attachment member supported by the base member and positioned to selectively connect the base member to the rotor;

a resilient member coupled to the base member to retain the first attachment member within the base member, the resilient member sized to contact both of the adjacent blades; and a support member sized to fit between the blades and fixedly connected to the base member.

12. The masking system of claim 11, wherein the resilient member includes a silicon foam material.

13. The masking system of claim 11, wherein the resilient member includes a first edge curved to match the shape of a first of the adjacent blades and a second edge curved to match the shape of a second of the adjacent blades, and wherein the resilient member is larger than a space between the first blade and the second blade such that the first edge and the second edge simultaneously contact both of the first blade and the second blade.

14. The masking system of claim 11, wherein the resilient member is sandwiched between the base member and the support member.

15. The masking system of claim 11, wherein the first attachment member includes three separate magnets and wherein the base member defines three pockets each sized to receive one of the magnets.

16. The masking system of claim 11, further comprising a third quantity of side covers, each side cover positioned adjacent the blade root of one of the blades and connected to one of the center plates, each side cover including a second resilient member positioned to surround a portion of the adjacent blade root, and a second attachment member operable to attach the side cover to the rotor and to compress the second resilient member.

17. The masking system of claim 11, wherein the first quantity and the second quantity are equal, and the third quantity is two times the first quantity.

18. The masking system of claim 16, wherein each center plate includes one of a tongue or a groove and each side cover includes the other of the tongue and groove so that each side cover interlocks with one of the center plates.

19. A masking system for a turbine including a first quantity of blades attached to a rotor and arranged adjacent one another to define a blade row, each blade including a blade root, the masking system comprising:

a second quantity of center plates, each disposed between two adjacent blades;

a third quantity of side covers, each side cover positioned adjacent the blade root of one of the blades, each side cover including:

a plate member sized to cover the blade root and a portion of the rotor such that the plate members cooperate to completely cover an annular area that includes each blade root and a rotor surface between the blade roots;

a resilient member positioned between the rotor and the plate member and sized to surround a perimeter of the blade root; and a first attachment member coupled to the plate member and operable to attach the plate member to the rotor and to compress the resilient member between the plate member and the rotor.

20. The masking system of claim 19, wherein the first attachment member includes a magnet.

21. The masking system of claim 19, wherein the resilient member is an O-ring.

22. The masking system of claim 19, wherein each center plate includes a second resilient member in contact with each of the two adjacent blades, and a second attachment member operable to attach the center plate to the rotor.

23. The masking system of claim 19, wherein each center plate includes one of a tongue or a groove and each side cover includes the other of the tongue and groove so that each side cover interlocks with one of the center plates.

24. The masking system of claim 23, wherein the tongue and grooved are sized to position the center plate over the blade root.

* * * * *